US007622003B1

(12) United States Patent
Heysek

(10) Patent No.: US 7,622,003 B1
(45) Date of Patent: Nov. 24, 2009

(54) PAINT EDGER HAVING IMPROVED BARRIER EDGE

(76) Inventor: Marie Heysek, 1005 Arrowhead Trail, Aurora, OH (US) 44202

( * ) Notice: Subject to any disclaimer, the term of this patent is extended or adjusted under 35 U.S.C. 154(b) by 407 days.

(21) Appl. No.: 11/334,065

(22) Filed: Jan. 19, 2006

(51) Int. Cl.
*B05C 21/00* (2006.01)

(52) U.S. Cl. ..... 118/504; 118/505; 15/144.1; 15/145; 15/236.01

(58) Field of Classification Search ..... 118/504, 118/505; 15/144.1, 145, 236.01; 30/169; 7/105
See application file for complete search history.

(56) References Cited

U.S. PATENT DOCUMENTS

| | | | | |
|---|---|---|---|---|
| 3,714,675 | A * | 2/1973 | Koptelow | 15/244.1 |
| 3,942,472 | A * | 3/1976 | McAlister | 118/504 |
| 4,085,703 | A * | 4/1978 | Glowacki | 118/504 |
| 4,852,203 | A | 8/1989 | LaBelle | |
| 5,095,573 | A * | 3/1992 | Henke et al. | 15/105 |
| 5,331,710 | A | 7/1994 | Tollasepp | |
| 6,076,225 | A | 6/2000 | Sorenson | |
| 6,179,387 | B1 * | 1/2001 | Nasset et al. | 301/37.102 |
| 6,523,219 | B1 | 2/2003 | Anderson | |
| 2002/0104182 | A1 * | 8/2002 | Panfili et al. | 15/236.01 |
| 2004/0050324 | A1 * | 3/2004 | Copp | 118/504 |
| 2005/0118345 | A1 | 6/2005 | Burghoffer | |

* cited by examiner

*Primary Examiner*—Laura Edwards
(74) *Attorney, Agent, or Firm*—D. Peter Hochberg; Sean F. Mellino; Daniel J. Smola

(57) ABSTRACT

An improved paint edger is provided having a laterally elongated edger head supported by a perpendicularly affixed handle. The blade itself is formed integrally to the frame, but demarcated by a joint aligning the tapered upper surface. Opposite the tapered upper surface, a flat lower surface is recessed by an offset of a specific dimension to receive an absorbent tape. The tape is affixed to the flat lower surface by an adhesive, and provides an absorbent material to provide a wicking action for paint that may pass the outer edge. Finally, the tape is provided with a non-porous barrier film that prevents passage of fluid (paint) and allows the paint to be retained within the tape.

6 Claims, 6 Drawing Sheets

PAINT EDGER HAVING IMPROVED BARRIER EDGE

RELATED APPLICATIONS

There are no previously filed, nor currently any co-pending applications, anywhere in the world.

BACKGROUND OF THE INVENTION

1. Field of the Invention

The present invention relates generally to painting tools and, more particularly, to a paint edger having an improved barrier edge with replaceable absorbent tape.

2. Description of the Prior Art

In the past, it has been customary, when painting interior and exterior surfaces, such as walls and ceilings, to apply the major portion of the surface covering using a paint roller. Whether or not a roller is used on the major parts of the wall surface, it is almost always desirable to carry out the edging process as precisely and quickly as possible in order to impart a high quality appearance to the finished room, wall panel or the like. As those familiar with painting are aware, the process or edging or "blocking out" an area such as an interior room, to be painted, often requires much more care and effort than painting the larger areas of the room. "Blocking out" consists of forming a band of paint around all the outer margins of a room, such as where a wall meets a ceiling, where a wall or ceiling meets trim, such as door and window trim, wainscoting or the like. The trim edge of this band of paint must be precisely formed. As used herein, "trim edge" means a hard edge, the one side of which is a full layer of paint, with none on the other side. A "feather edge" occurs on the opposite side of the band of paint; as used here, "feather edge" means a blended marginal area at which the contrast between painted and unpainted areas is slight and the separation between painted and unpainted areas is an irregular and feather-like locus rather than a straight, distinct line. If the hard or trim edge portion to be painted is at the junction of adjacent walls, or a wall and a ceiling, a wavy or meandering edge will create a low quality appearance. If the area to be painted includes an edge or margin bounded by wood or other trim, a poorly applied edge will result in spattering or coating the trim with paint, or leaving unsightly gaps between the trim and paint.

As is well known in the art, a various specialty apparatus for painting and controlling the application of paint to edges, corners, or like margins of painted surfaces are known. However, such devices have drawbacks that tend to fall into three major categories. First are fixed edger devices that are generally hand held to demarcate between surfaces to be painted and those that are not. Most 'edgers' are simple blocking devices having little technology to provide for a clean, efficient 'edge' during painting. Second are disposable coverings that are adhered by adhesives or the likes, and are dispensed in the form of tapes, paper rolls, or, in the case of windows, liquid appliable films that can be peeled or removed after use. Such devices are, at the very least, time consuming, difficult to use, and expensive. Third are more recent category of products that attempt to incorporate a painting application device in combination with a guide or edging means to apply paint in a manner such that it only flows onto the surfaces that it is intended, attempting to eliminate the need for edgers altogether. However, such devices in practice generally fail to provide a painted edge along a very exact locus so as to provide a high quality appearance in the finish painted surface. Further, such devices can rarely accommodate the preferred application tool, the hair bristled paint brush, but instead use pads, sponges, or other planar paint applicators.

A search of the prior art did not disclose any patents that read directly on the claims of the instant invention; however, the following references were considered related.

U.S. Pat. No. 5,331,710, issued in the name of Tollaseep, discloses a paint edger having a paint pad with an application end on a handle and a spacer that slides from a retracted to an extended position so that it controls the approach of a paint pad to a surface perpendicular to that being painted.

U.S. Pat. No. 6,076,225, issued in the name of Sorenson, discloses a number of forms of painting trays and accessories. These include a paint tray having an upper or intermediate foam pad across the top thereof to prevent spillage. The paint will only flow through the foam at a very slow speed. One embodiment is disclosed wherein the paint tray includes a cover and has a plurality of variable porosity pads. Another unit includes a round tray, a round pad, and a round applicator unit. Several painting accessories are described, including a painting pad having a plurality of wells therein as well as being made from a porous, sponge-like material.

U.S. Pat. No. 4,852,203, issued in the name of LaBelle, discloses a paint edger for the application of paint. This improved invention is to provide the user with an easy improved method of edging paint on walls or surfaces usually adjacent to ceilings or other walls or surfaces, with the important provision of being able to paint into the corner of another wall and ceiling.

U.S. Pat. No. 6,523,219, issued in the name of Anderson, discloses a window scraper guide having a base with a first straight edge disposed between an upper surface and an opposing lower surface. A pair of sides extend perpendicularly rearward a first predetermined distance from the first straight edge. The distance between the upper surface and opposing lower surface is a second predetermined distance. A side shield extends upwardly from one side of the pair of sides, and the side shield has a second straight edge aligned with the first straight edge. A handle portion extends at a predetermined angle from the lower surface of the base.

And, U.S. Publication 2005/0118345, published in the name of Burghoffer, describes a paint edger and a method of applying a surface coating to one or both of two intersecting surfaces without applying paint to the corresponding surface are disclosed. The applicator pads may be separated so that each may be used simultaneously and independently of the other to apply a different color paint at the same time to each of two intersecting surface. One or more applicator pads coact with a separator guide blade to enable applying different surface coatings to intersecting surfaces.

Consequently, a need has been felt for providing an apparatus and method of providing a reusable device used in conjunction with painting that provides a clean, improved and efficient paint 'edge'.

SUMMARY OF THE INVENTION

It is therefore an object of the present invention to provide an improved paint edger.

It is a feature of the present invention to provide an improved paint edger having an improved barrier edge with replaceable absorbent tape.

Briefly described according to one embodiment of the present invention, an improved paint edger is provided having a laterally elongated edger head supported by a perpendicularly affixed handle. While the handle is capable of supporting any number of ergonomic improvements, the edger head is formed of a supporting frame that extends outward to a flexible angled blade. The blade itself is formed integrally to the frame, but demarcated by a joint aligning the angled upper surface. It is also anticipated that both blade and handle could also be molded together as a single element. Opposite the angled upper surface, a flat lower surface is recessed by an offset of a specific dimension to receive an absorbent tape. The tape is affixed to the flat lower surface by an adhesive, and provides an absorbent material to provide a wicking action for paint that may pass the outer edge. Finally, the tape is provided with a non-porous barrier film that prevents passage of fluid (paint) and allows the paint to be retained within the tape.

In accordance with a preferred embodiment, the removable absorbent tape functions as a secondary seal to prevent smearing or leaking of paint that happens to pass by the flexible outer edge.

In accordance with an alternate embodiment, the blade edge itself is detachable and removable as a possible disposable feature.

In addition to this preferred edging function that it affords, an advantage of the present invention is that the absorbent tape can be removed and replaced in order to prevent saturation.

Another advantage of the present invention is that the teachings and functions of the improved edger blade can be adapted to various shaped edger heads to satisfy a variety of specific needs.

Further, the handle is capable of supporting any number of ergonomic improvements in conjunction with the other features and benefits herein.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
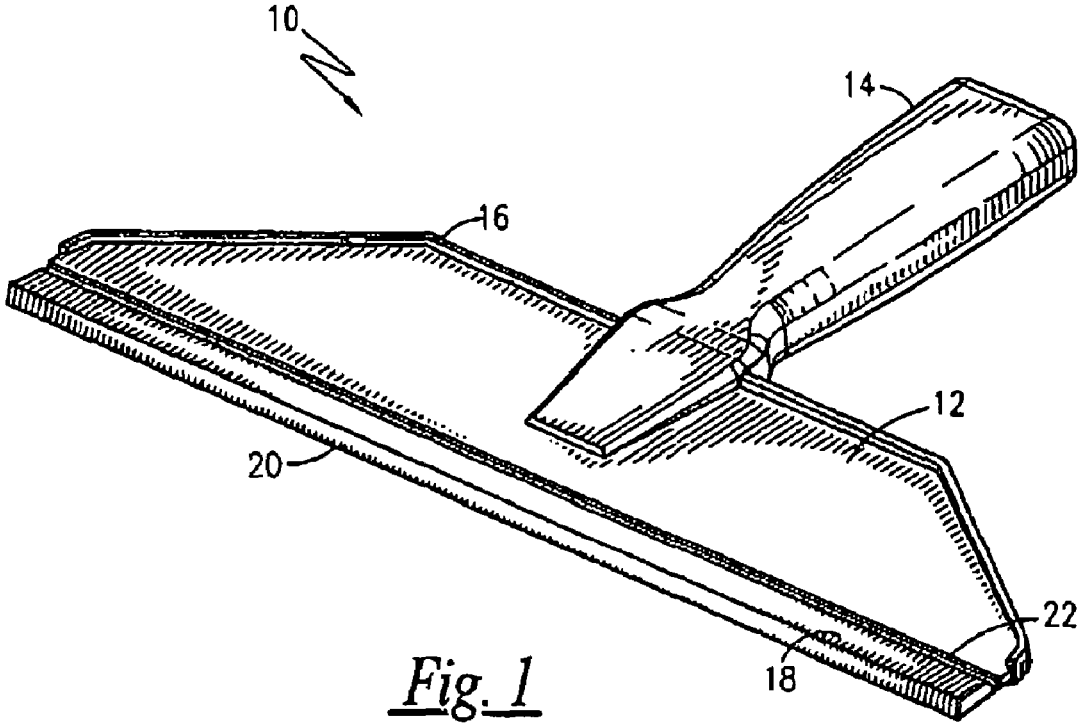
FIG. 1 is a left-top perspective view of a paint edger having improved barrier edge according to the preferred embodiment of the present invention.
Figure 2:
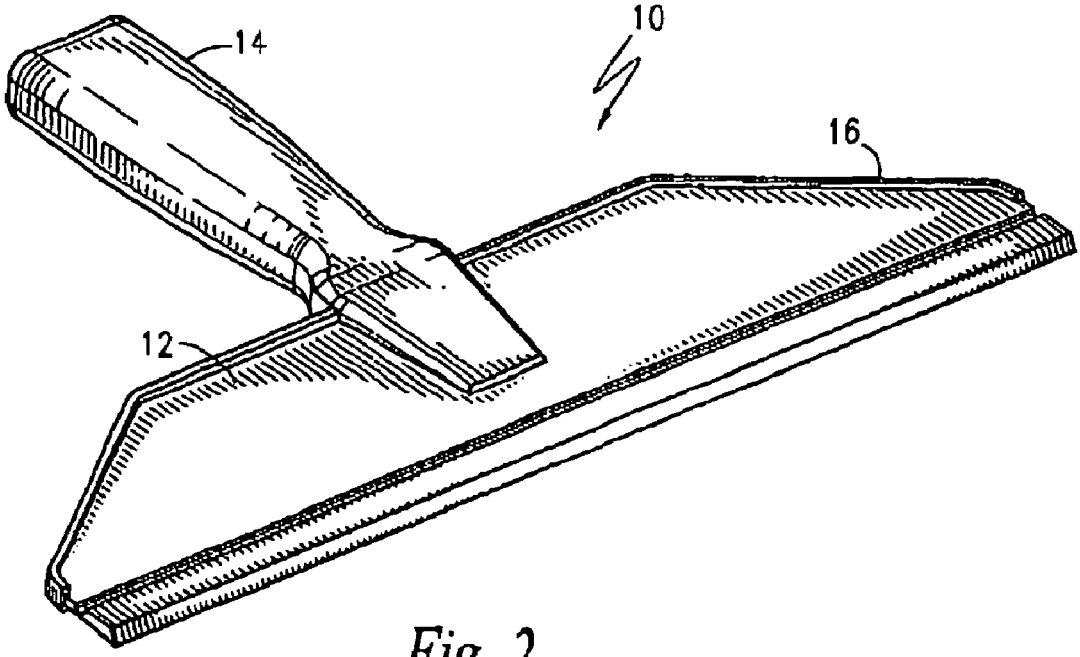
FIG. 2 is a right-top perspective view thereof.
Figure 3:
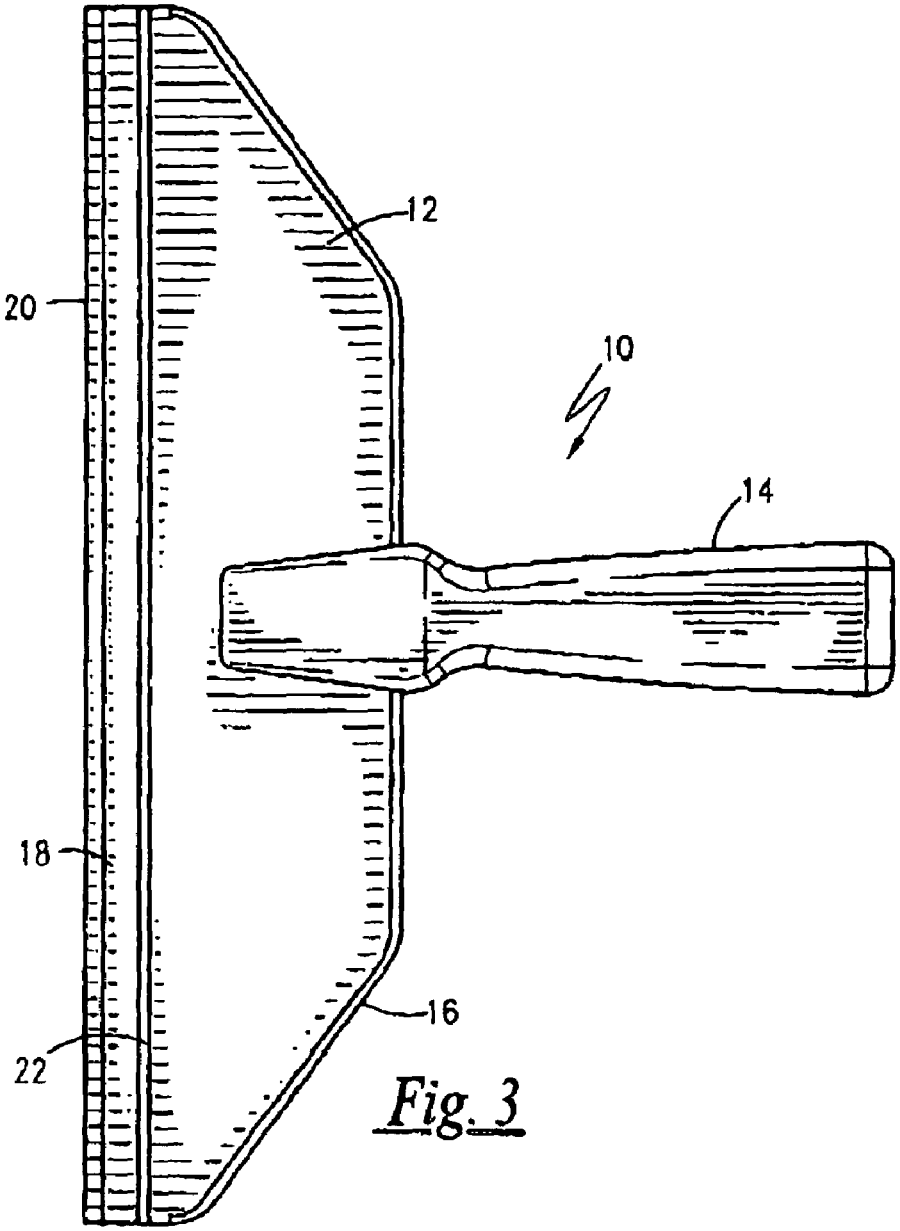
FIG. 3 is a top plan view thereof.
Figure 4:
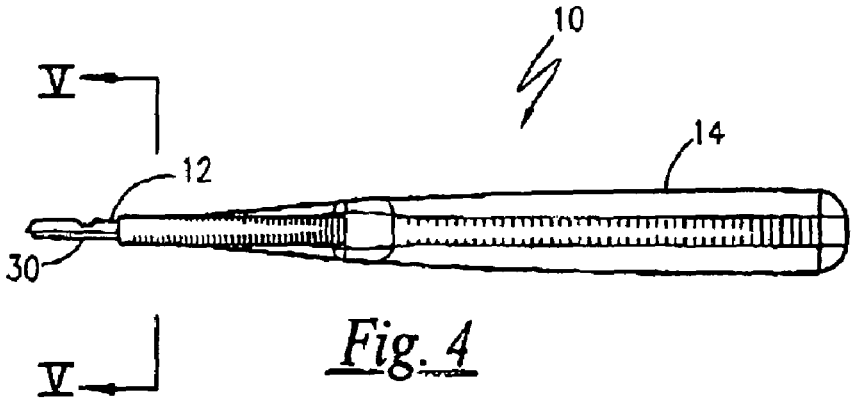
FIG. 4 is a side elevation view thereof.
Figure 5:
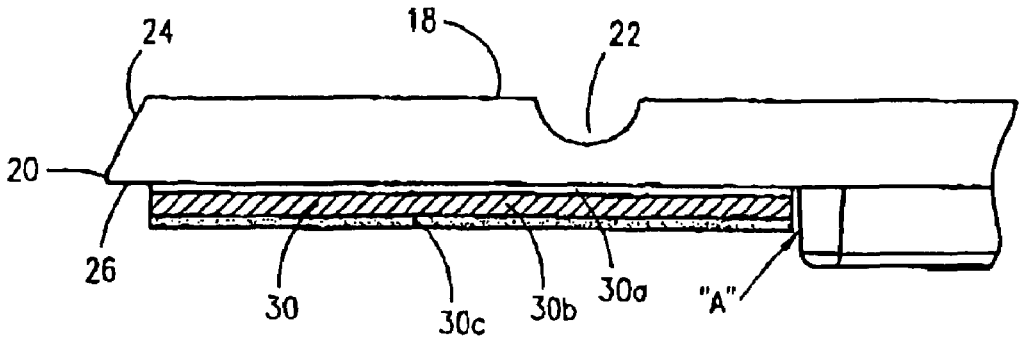
FIG. 5 is an enlarged cross sectional side elevation of part of a blade according to a preferred embodiment of the invention.

It is envisioned that other styles and configurations of the present invention can be easily incorporated into the teachings of the present invention. Only one particular configuration shall be shown and described for carrying out the invention as presented in terms of its preferred embodiment, herein depicted within the Figures. This is for purposes of clarity and disclosure and not by way of limitation of scope.

Referring now to FIGS. 1 through 5, an improved paint edger apparatus 10 is shown, according to the present invention, provide having a laterally elongated edger head 12 supported by a perpendicularly affixed handle 14. By way of example, and not as a limitation, the handle 14 is capable of supporting any number of ergonomic improvements, not the least of which would be to integrate the handle 14 and head 12 as a unitary component, for facilitation of the teachings herein and to provide sufficient enablement of the elements of the innovation. The handle 14 is shown in a simple and straightforward design attached mechanically or by adhesive to the head 12, with both formed of molded plastic (preferably polyethylene). The edger head 12 is formed of a supporting frame 16 that extends outward to an angled edger blade 18 that terminates at a flexible outer edge 20. The outer edge 20 is anticipated to be firm and stiff, yet flexible enough to conform to slightly irregular surfaces with the application of minor or moderate force. The blade 18 itself is formed integrally to the frame 16, but demarcated by a joint or groove 22 parallel to the angled upper surface 20. It is anticipated as an alternate embodiment of the blade 18 would be detachably (and disposably) affixed rather to, rather than integrated with, the handle. As shown best in greater detail in FIG. 5, opposite the acutely angled chamfer 24, a flat lower surface 26 is recessed by an offset "A" of a specific dimension coordinated to receive an absorbent tape 30. The tape 30 is affixed to the flat lower surface 26 by an adhesive 30*a*, and provides an absorbent material 30*b* to provide a wicking action for paint that may pass the outer edge 20. Finally, the tape 30 is provided with a non-porous barrier film 30*c* that prevents passage of fluid (paint) and allows the paint to be retained within the absorbent portion 30*b* of the tape 30.

Figure 8:
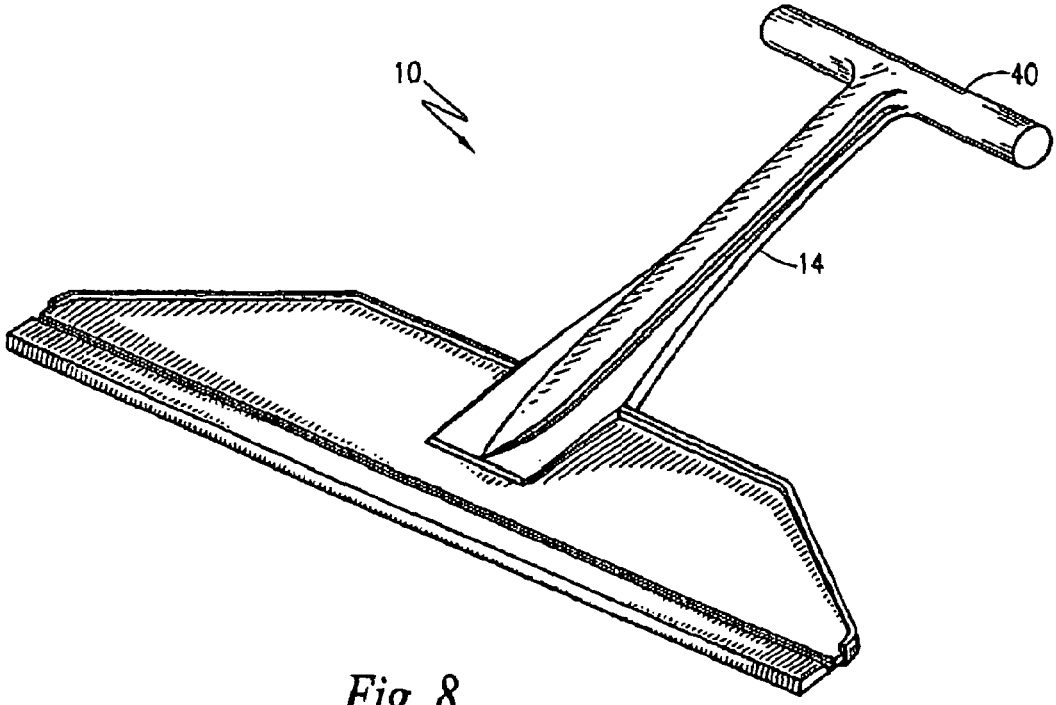
FIG. 8 is a perspective view of one example of an embodiment of a paint edger having an improved barrier edge and exhibiting an alternate gripping means

As described above, it is anticipated that the handle 14 is capable of supporting any number of ergonomic improvement. FIG. 8 provides an example of one such anticipated modification to the handle that augments and does not divert from the teachings of the present invention as it relates to an improved barrier edge. As shown, the handle 14 may support an additional cushioned grip that provides a grasping surface to compliment various geometries of handling to allow a user additional flexibility of use when accommodating difficult work spaces or work positions.

Figure 9:
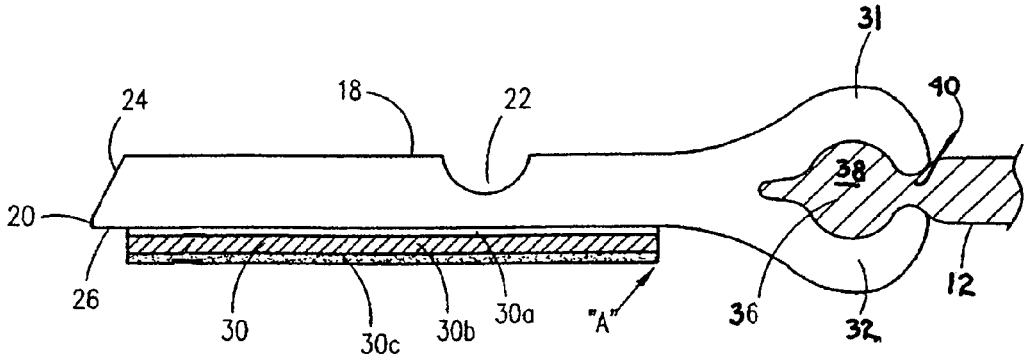
FIG. 9 is an enlarged cross sectional side elevation of part of a blade according to a preferred embodiment of the invention.

As referred to above, another example of anticipated modifications to the current teachings are shown in FIG. 9, which shows a second alternate embodiment in which the handle 14 is capable of being detachably or removably supporting the head blade 18. For facilitation of the teachings herein and to provide sufficient enablement of the elements of the innovation the handle 14 is shown in a simple and straightforward design molded integrally to the head 12, with both formed of molded plastic (preferably polyethylene), with the edger blade 18 being of an interlocking design such as to form a mechanical impingement when slid together with the head 12. It is anticipated that alternate to mechanical impingement, other conventional attachments means, such as fasteners or adhesive, can also be used. To accomplish this, it is anticipated that the edger head 12 then is adapted with a supporting frame 16 that slidably engages with the blade 18 which extends outward to an angled edger blade 18 that terminates at a flexible outer edge 20 as in previous embodiments.

FIG. 9, showing the cooperation between blade 18 and head 12, can be described more in detail as follows. Blade 18 has a pair of opposing walls 31 and 32 which are disposed on an edge portion 34 on the opposite part of blade 18 from outer edge 20. Walls 31 and 32 define a channel 36. Head 12 has a channel insert such as bead 38 extending across head 12, and is dimensioned to fit in channel 36. The inside end portions 40, 42 of walls 31, 32 are close enough to each other to prevent bead 38 from moving in any direction except longitudinally in channel 36, so that bead 38 cannot move in a direction transverse to channel 36 and escape therefrom. One applies paint using head 12 and blade 18 with a paint applicator (preferably a brush) until the absorbent layer in the tape is filled with paint from the paint applicator. Blade 18 is thus removably held in channel 36 of head 12, and can easily be replaced by sliding blade 18 with bead 38 out of an end of channel 36, and replaced with another blade by moving the bead 38 of the new blade 18 into channel 36. The blade is disposable (and referring to other embodiments with a one-piece head and blade, the entire unit could be disposable). Of course, the bead 38 and channel 36 could be reversed, with the channel 36 being formed in head 12 and the bead on 38 on blade 18. Chamfer 24 would be appropriate for the type of paint used and the applicator, and could range from a very sharp angle with lower surface 26 to a lesser sharp angle, i.e. from a gentle slope to a severe slope.

Figure 6:
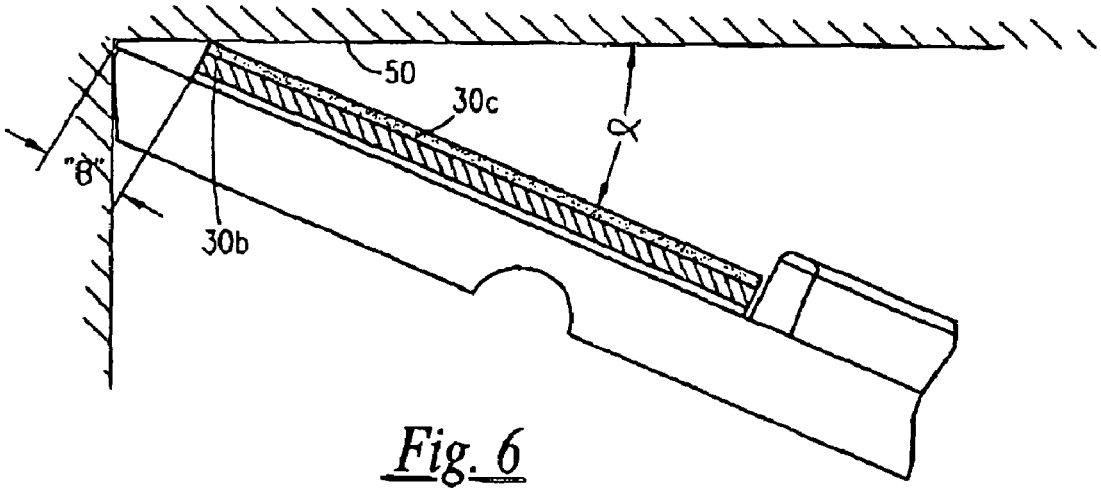
FIG. 6 is the cross sectional view of FIG. 5 shown in use.
Figure 7:
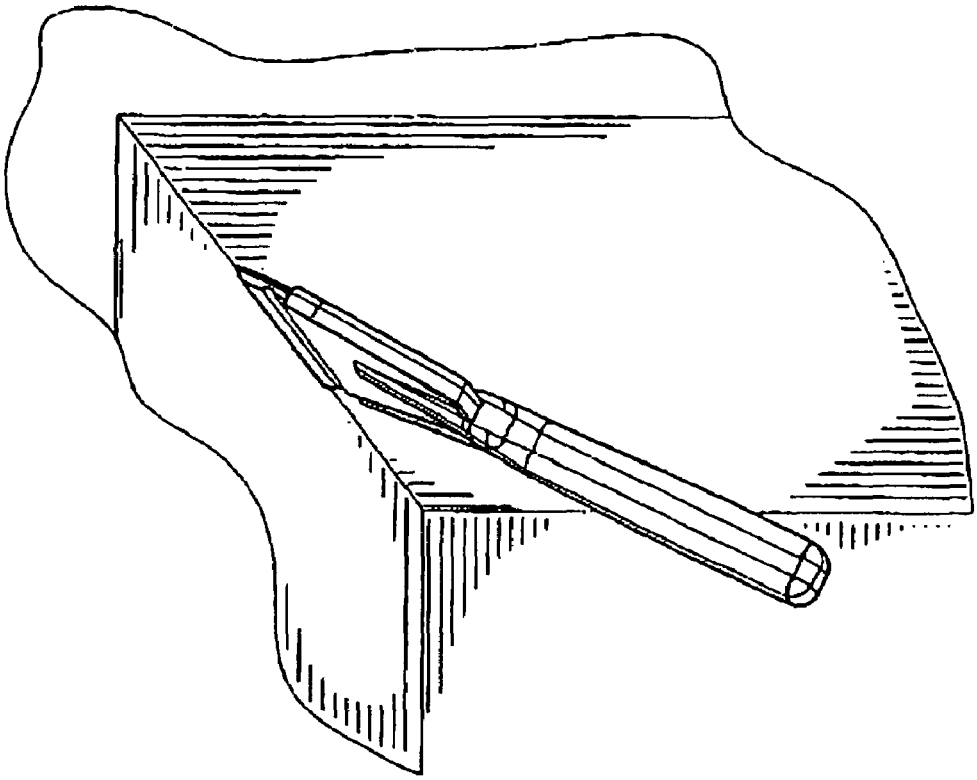
FIG. 7 is a perspective view thereof of the use shown in FIG. 6.

In accordance with a preferred embodiment of the present invention as shown best in FIGS. 6 and 7, to use the present invention, a user will first apply a tape strip 30 to the lower surface 26 of the blade 18. During conventional painting of walls or ceilings 50 with an otherwise conventional paint brush, the user will hold the edge 20 along the desired line, tape 30 toward the painted surface 50, at an angle "a" formed acutely between the edger 10 and the surface 50. Such an angle "a" allows the barrier 30*c* to also contact the painted surface 50, thereby forming a secondary edger line or seal, while at the same time providing a conduit for any leakage past the edge 20 to be absorbed into the absorbent material 30*b*. It is anticipated that, by providing an offset "B" between the edger 20 and the outer terminus of the tape 30 of approximately 0.10 inches, this angle would result in a desirable position between edger 10 and wall 50. This anticipates a blade thickness of preferably 0.123 inches, with a preferred range of between 0.062-0.156 inches. However, it is anticipated that because the painted surface 50 generally is not or cannot be manufactured to the same degree of precision and tolerance as the edger 10, such an angle "α" will vary, depending upon the situational needs of the user. As such, the embodiment as shown and described is particularly adapted to accommodate such variations in situational needs.

By utilizing the device 10 in this manner, the user can apply paint along the edger, moving the brush back and forth in mid-section and away from the ends. By sliding the edger, the tape provides a cushion shield barrier which enables the stabilizing of the edger, allowing it to slide along easier to form a continuous edge in a quick, efficient and effective manner. As the paint accumulates along the edge, it can be wiped as needed. However, eventually as the tape becomes saturated, it can be removed and discarded and replaced with a fresh, clean tape ready to be used again without excessive delay.

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable the user to best utilize the inventions and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A paint edger for enabling the painting of a trim edge on a surface being painted with a paint applicator, said paint edger comprising:

an edger head for holding an elongated blade;

an elongated blade connected to said edger head, said elongated blade comprising:

a back elongated surface for holding an absorbent tape; and a front elongated surface on the opposite side of said blade from said back elongated surface, said front elongated surface having a free end defining an outer edge and a chamfer on said front elongated surface and terminating in said outer edge, said chamfer extending along the length of said front elongated surface;

said elongated blade having a connecting edge portion at the part of said elongated blade opposite said outer edge;

said connecting edge portion of said blade having opposing walls defining a channel, and said head having a channel insert dimensioned for sliding movement in said channel, said opposing walls dimensioned to prevent said channel insert from moving in any direction except for said sliding movement;

said elongated blade further including a joint offset from said channel and extending along said front elongated surface generally parallel to said outer edge;

said blade being removable and replaceable in said head; and absorbent tape attached to said back elongated side of said elongated blade at a predetermined distance from said free edge, said absorbent tape comprising:

a paint absorbent layer having an edge portion disposed at said predetermined distance for absorbing paint that may flow around said chamfer and onto said back elongated surface to leave a crisp trim edge when trim painting is completed with said paint edger and a non-porous barrier film covering said paint absorbing layer to prevent paint from flowing from said paint absorbent layer;

said paint edger being held with said front elongated surface facing the surface being painted, and a paint brush or applicator being moved against said front elongated surface, with any paint flowing beneath said outer edge being absorbed by said absorbent layer on the opposite side.

2. A paint edger according to claim 1 wherein said paint edger further includes a structure associated with said back elongated surface of said elongated blade for cooperating with said absorbent tape to locate said absorbent tape on said back elongated surface of said elongated blade to position said edge portion of said paint absorbent layer at said predetermined distance.

3. A paint edger according to claim 2 wherein said structure associated with said back elongated surface comprises a recess in said back elongated surface for receiving said absorbent tape and position said edge portion of said paint absorber layer at said predetermined distance.

4. A paint edger according to claim 1 and further including a handle extending from said head, said handle being perpendicular to said elongated blade and located on the opposite part of said head from said elongated blade.

5. A paint edger according to claim 1 and further including adhesive on said back elongated surface of said elongated blade for attaching said absorbent tape to said back elongated surface.

6. A paint edger according to claim 1 wherein said outer edge of said elongated blade is firm, yet flexible enough to conform to any slightly irregular parts of the surface being painted.

* * * * *